United States Patent [19]

Maxwell

[11] 4,043,080

[45] Aug. 23, 1977

[54] DIE LAPPING APPARATUS

[75] Inventor: Thomas H. Maxwell, Carnegie, Pa.

[73] Assignee: Die-Quip Corporation, Carnegie, Pa.

[21] Appl. No.: 619,962

[22] Filed: Oct. 6, 1975

[51] Int. Cl.[2] ..... B24B 33/02

[52] U.S. Cl. ..... 51/33 W; 51/50 R

[58] Field of Search ..... 51/33 W, 34 C, 34 H, 51/48 R, 50 R

[56] References Cited

U.S. PATENT DOCUMENTS

| | | | |
|---|---|---|---|
| 1,468,151 | 9/1923 | Heald | 51/50 R |
| 1,826,347 | 10/1931 | Haddow | 51/50 R |
| 2,251,607 | 8/1941 | Astrowski | 51/34 H |
| 3,883,994 | 5/1975 | Dellinger | 51/34 C |

*Primary Examiner*—Gary L. Smith

*Attorney, Agent, or Firm*—Frank P. Cyr

[57] ABSTRACT

An apparatus for effecting the combined simultaneous rotating and reciprocating movement of a die reconditioning tool mounted in a chuck which is secured to a rotating and reciprocating spindle. The reconditioning tool may be employed either in the rough grinding of a used die or may be employed to polish a die which may or may not have been previously subjected to a rough grinding operation. The improvement comprising the employment of a hub mounted for rotation with the main shaft of a lathe-type apparatus with the hub having a slot formed therein and a plate adjustably mounted in the said slot with a suitable linkage mechanism extending between the said plate and the reciprocating parts of the apparatus on which is mounted the said spindle whereby the length of reciprocating travel of the spindle and reconditioning tool mounted thereon may be varied by adjusting the plate in the slot formed in the aforesaid hub.

2 Claims, 13 Drawing Figures

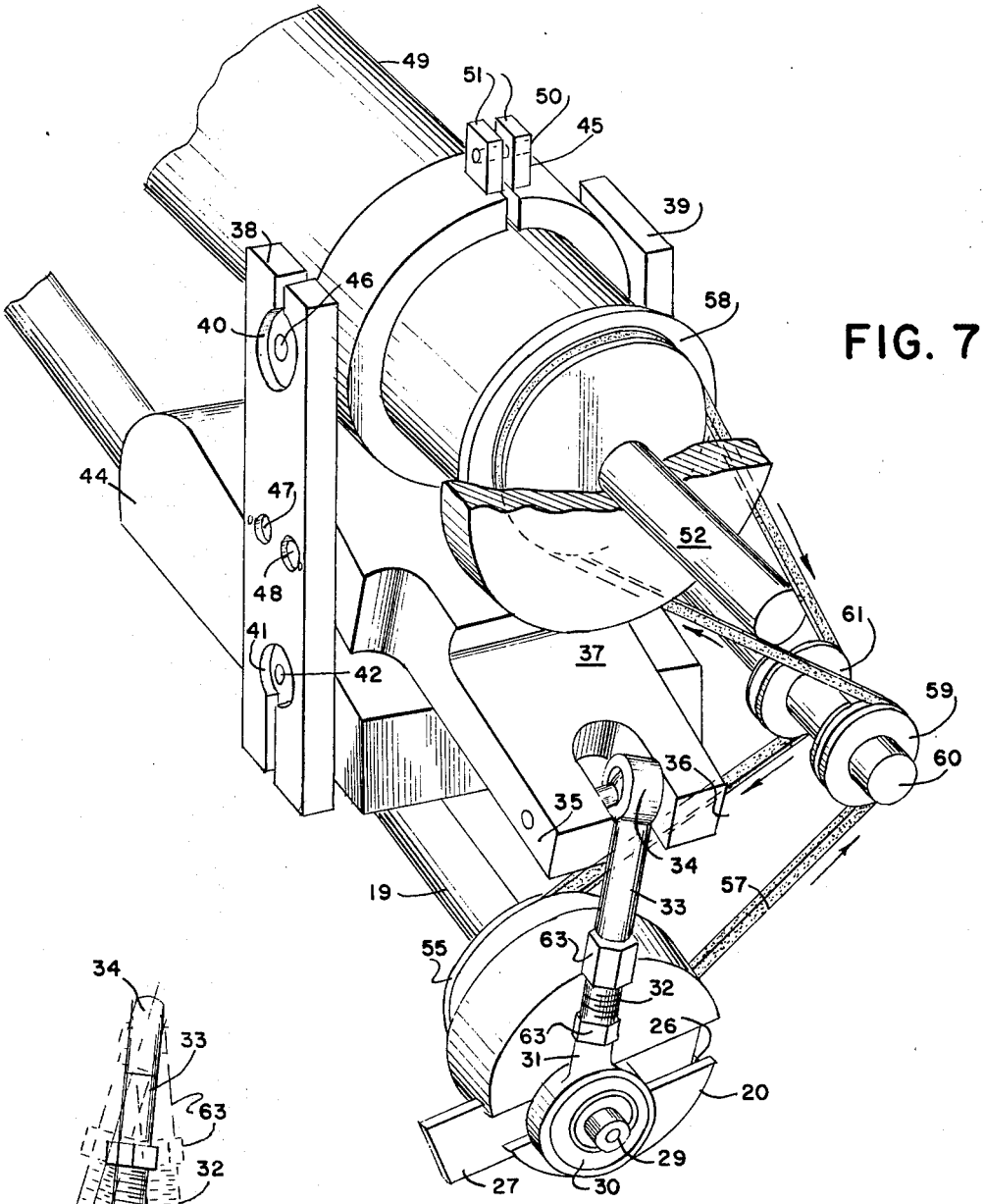
FIG. 7
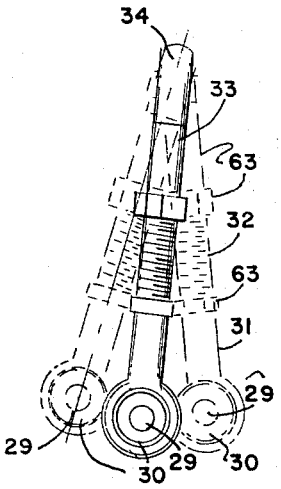
FIG. 9
FIG. 8
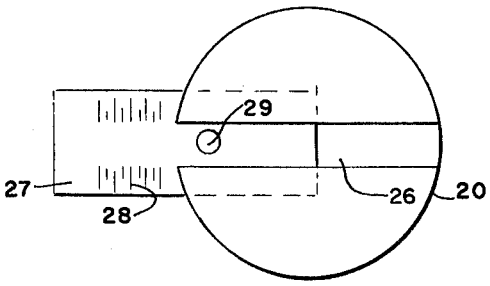

DIE LAPPING APPARATUS

BACKGROUND OF THE INVENTION

Dies employed in the drawing of metals and particularly those employed in the wire drawing art are usually formed by encasing a carbide insert in a steel casing. The insert is usually provided with a conical or tapered area which forms the front of the die and normally extends from about two-thirds to three-quarters through the insert and terminates in an orifice or opening commonly referred to as the land portion at the rear end of the die which defines the size or diameter of the object formed when the metal stock, usually in the form of a rod, is drawn through the die.

In the wire drawing art, the size of the orifice or land portion at the rear end of the die will determine the size or diameter of the wire by drawing the metal stock through the land or die opening. As can be appreciated, and notwithstanding the fact that the die insert is usually made of an extremely hard substance such as carbides, the die orifice or land portion as well as the walls of the conical or tapered portion of the die are subjected to wear due to the passage of metal therethrough and when this occurs the wire emanating from the die orifice or opening will have imperfections on the outer surface thereof such as scratch marks or the like. To avoid the formation of such imperfections on the drawn wire, the used die is removed from it's mounting on a drawing frame structure and the same is then subjected to a reconditioning operation. When a die is to be reconditioned, the die is usually mounted on a rotating head-stock of a lathe-type apparatus and a reconditioning tool having the required external dimensions is mounted on a spindle which is caused to simultaneously reciprocate and counter rotate with respect to the aforesaid head-stock and to engage with the said conical walls and the die opening or land portion to recondition the same.

The lapping tool for polishing the conical portion of the die comprises a metal pin-like member having a tapered portion at one end thereof which is designed to engage in point contact only the conical tapered wall of the die. A lapping tool for reconditioning the land portion of the die in a polishing operation, comprises a metal pin-like member having an external diameter slightly lesser than the diameter of the land to be reconditioned, and here again the tool engages the land portion in point contact only. The lapping tool for rough grinding a die comprises a metal pin-like member having a tapered portion at one end thereof and during the lapping operation the tapered portion of the tool engages the entire area of the tapered portion of the die to thereby remove by ripping from therein the burrs or other imperfections formed therein by reason of the metal being drawn therethrough. Also, in rough grinding a die, the land portion thereof can likewise be reconditioned by employing a tool having a slightly larger diameter than the diameter of the land portion to be reconditioned and to cause said tool to cut away some of the land area thus enlarging the land area so that when the die is again used in a wire drawing operation, the wire issuing from the die will be larger in diameter than the wire drawn from the die prior to the same having been reconditioned, as aforesaid. As can be appreciated, if the land portion is not subjected to a reconditioning operation, but only the tapered portion reconditioned, the size of the wire emanating from the die will remain the same as that drawn previously from the same die.

While in most metal drawing operations it is desirable to employ a die which has been subjected to a polishing operation to insure the removal of all imperfections from the tapered wall as well as the land portion of the die, to thereby produce a wire free of any imperfections on the outer surface thereof, there are instances where a die which has been subjected only to a rough grinding operation will be found satisfactory to form a wire which will be acceptable notwithstanding the slight imperfections appearing on the outer surface thereof.

Normally, the carbide insert in a die having a steel casing extending along the outer periphery thereof, will permit for the die to be repeatedly reconditioned to thus prolong the life of the die although, as stated above, following each such reconditioning operation, if the land portion of the die has been enlarged due to such reconditioning operation, the die will then be employed to draw a wire therethrough of a larger diameter.

In a lapping operation the lapping tool is mounted on a spindle which is caused to counter rotate with respect to the rotation of a head-stock on which has been mounted a die to be reconditioned, and to simultaneously reciprocate the spindle so as to engage the surfaces of the conical area of the die opening or land portion thereof, so that these surfaces are subjected to a ripping or polishing action to recondition these surfaces.

With the above in mind, it is the primary object of the invention to provide a means whereby the length of reciprocating travel of the rotation spindle having the lapping tool mounted thereon may be regulated.

Another object of the invention is to mount a rotating hub on the main drive shaft of a lathe-type machine tool and to provide a slot therein in which will be adjustably positioned and secured therein a plate member which will determine the length of the to and fro movement of the rotating spindle having the lapping tool mounted thereon.

Another object of the invention is to provide an apparatus which will enable a die to be perfectly centered in a chuck extending from a headstock whereby once the die has been centered in the chuck, the rough grinding of the die, including not only the tapered portion of the die but the land portion as well may be reconditioned should it be necessary to recondition this area of the die, the only change necessary to effect the reconditioning of the tapered wall of the die and the land portion, is a change in the lapping tool which is employed in these reconditioning operations.

Another object of the invention is to provide an adjustable linkage between the rotating and reciprocating spindle whereupon when the plate arrangement on the rotating hub structure is shifted from one position to another, the linkage can likewise be adjusted to vary the length of the linkage between these parts of the apparatus.

Another object of the invention is to provide a plurality of marker indications on the plate extending in the slot formed in the rotating hub to thus enable one to readily vary and determine the length of reciprocating travel of the spindle and lapping tool mounted thereon.

Another object of the invention is to provide a die reconditioning apparatus which is fully automatic in operation and which is relatively free of moving parts thus rendering the same to be substantially trouble free.

Further objects and advantages of the invention will become apparent as the following description proceeds, and the features of novelty which characterize my invention will be pointed out with particularity in the claims annexed to and forming a part of this specification.

DESCRIPTION OF THE DRAWINGS:

FIG. 7 is an enlarged perspective view with pairs broken away of the drive end of my apparatus.

FIG. 8 is a view showing the slot in a hub and a plate having graduations formed thereon mounted therein.

FIG. 9 is a view showing the manner in which the turnbuckle is swiveled on it's associated parts.

Figure 1:
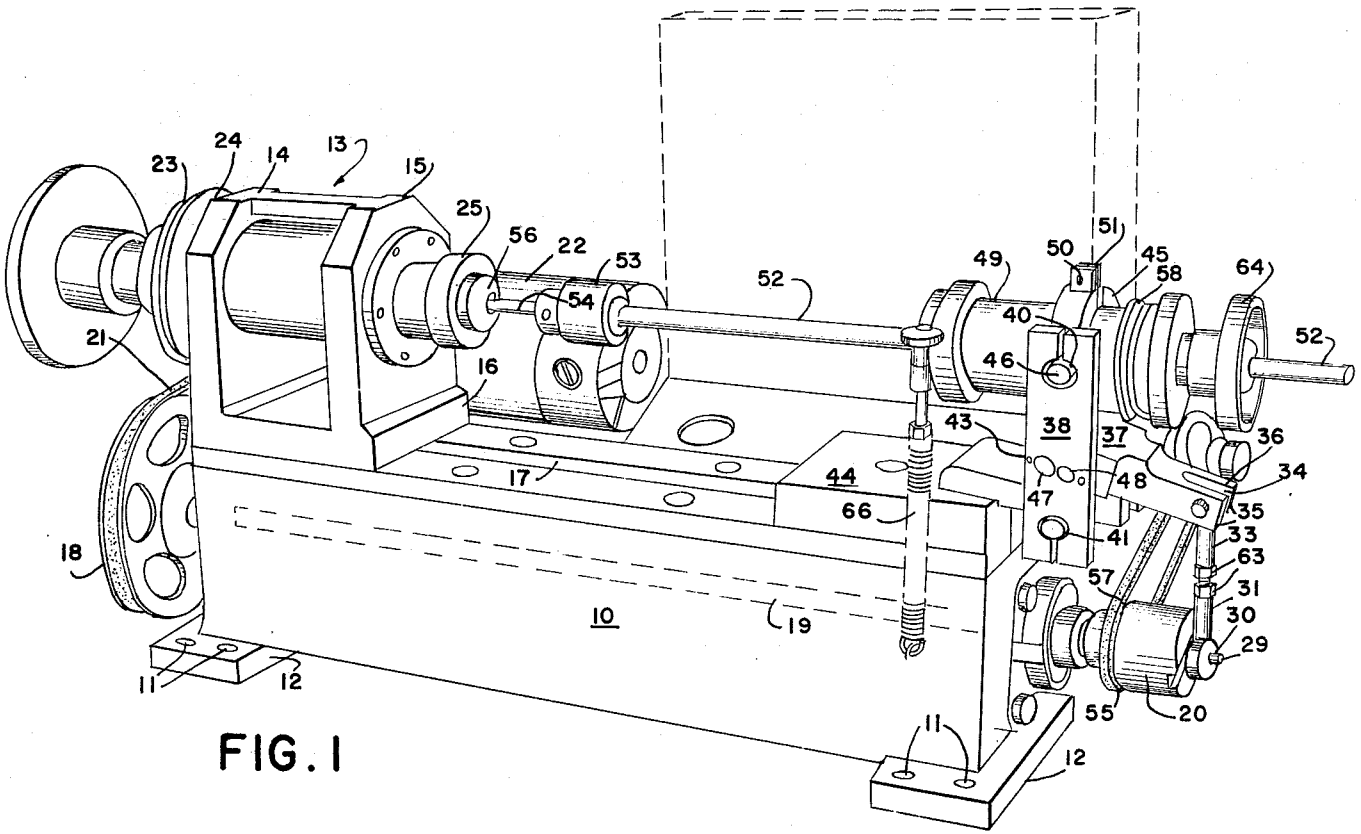
FIG. 1 is a perspective view of an automatic die lapping apparatus embodying my invention.

DESCRIPTION OF THE PREFERRED EMBODIMENTS:

Referring now to the drawings wherein there is shown several modifications of the invention, like reference numerals are employed throughout the several views to designate like parts, reference numeral 10 designates a base for the working parts of the die lapping or rough grinding tool, and the same may be constructed of metal or the like and is secured to a proper supporting surface (not shown) by means of bolts 11 or the like extending through extension plates 12 secured in any known manner to the undersurface of the base 10.

Mounted on the base 10 is a head-stock 13 of conventional construction. A pair of straps 14, 15 secure the head-stock 13 to a support plate 16, which is mounted for movement on the base 10 by means of a key-way 17 formed along the upper surface of the base 10. The plate and head-stock mounted thereon may be secured in any manner to the aforesaid key-way.

A pulley 18 is keyed or otherwise secured to a main drive shaft 19 which extends from the head-stock end of the apparatus through the base 10, and terminates at the opposite end of the base and forms a support for a concentrically mounted hub 20 which is keyed or otherwise secured to the aforesaid drive shaft 19 for rotation therewith. A belt 21 extends from the pulley 18 to a suitable motor 22 provided with a conventional drive shaft (not shown). A pulley 23 is mounted on a shaft extending into the head-stock 13 and a belt 24 extends from the pulley 23 to the aforesaid motor 22 to effect the rotation of a chuck 25 extending from the said headstock.

The rotary movement of the shaft 19 is effected through the belt and pulley arrangement, aforesaid, which also causes the hub 20 keyed thereto to rotate in the same direction as the said shaft 19. Also, through the belt 24 and pulley 23 arrangement, the chuck on the headstock is also caused to rotate in the same direction as the aforesaid shaft 19.

Figure 4:
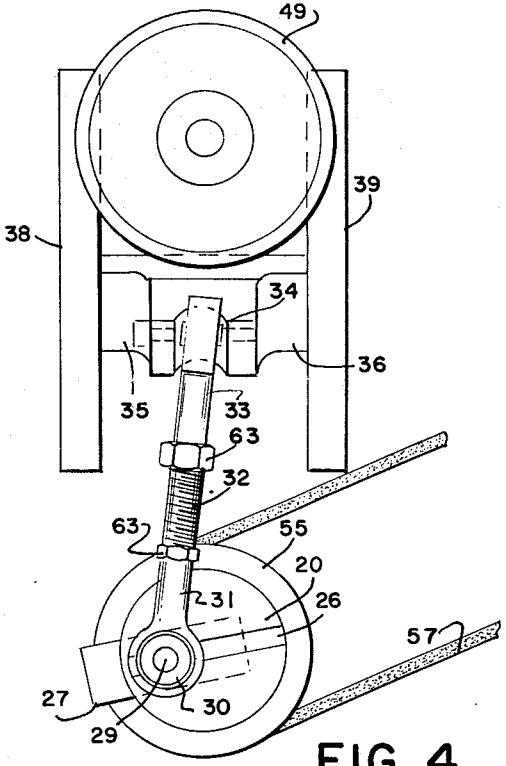
FIG. 4 is an enlarged sectional view showing the adjustable plate in the slot formed in a rotating hub.

As shown more clearly in FIG. 4 and 7 of the drawings, a slot 26 is formed in the hub 20 and a plate 27 having graduations 28 formed thereon is retained in adjusted position in the said slot by means of a set screw 29 which extends through a roller bearing assembly 30 which is mounted within an opening provided at the lower end of a connector rod 31 to thus pivotally mount the rod 31 on the set screw 29 for a purpose to be more fully described hereinafter. An externally threaded bolt 32 extends from the upper end of the connector rod 31 and threadingly engages with a like connector rod 33 which is swiveled on a bearing 34 mounted between a pair of bifurcated arms 35, 36 which are provided on a downwardly inclined block-like member 37 which extends between a pair of vertically disposed plates 38, 39. The plates 38, 39 are each provided with an upper bearing 40, and a lower bearing 41. A shaft 42, one for each of said lower bearings, extend from a supporting structure 43 fixed in any known manner to a bracket 44 which is fixed to the base 10 for thus pivotally mounting the plates 38, 39 on the said supporting structure 43.

A split collar 45 is provided with a pair of diametrically opposed shafts 46, only one shown in the drawings, and these shafts extends through the bearings 40 provided at the upper portion of the vertical plates 38, 39 to thus pivotally secure the split collar 45 to the upper portion of the aforesaid plates 38, 39. A pair of bolts 47, 48 extend through the said plates 38 and 39 and threadingly engage with internally threaded openings formed on the sides of the block 37 for securing the block to the two vertical plates 38, 39.

As can be appreciated, and with the block 37 secured to the plates 38, 39 by means of the bolt members 47, 48, any up and down movement of the block will cause said plates to pivot on their bearings 40, 41 and to impart to the said split collar 45 a reciprocating motion for a purpose to be explained more fully hereinafter.

A housing 49 is mounted within the split collar 45 and is secured therein by means of a bolt 50 extending through ears 51. The housing 49 is of conventional construction and has the requisite roller bearing assemblies therein to permit rotation of a shaft 52 which extends therethrough. A chuck 53 of conventional construction is mounted for rotation with the said shaft 52 and a die lapping tool 54 having the required taper formed thereon for engagement with a die to be finished is mounted on the said chuck 53 for rotation therewith. A pulley 58 is keyed or otherwise secured to the shaft 52 to effect a counter-rotation of the shaft and lapping tool mounted thereon in a manner to be described more fully hereinafter.

As stated previously, the chuck 25 on the headstock 13 is rotated by a belt and pulley arrangement leading to a suitable motor which also drives, again through a belt and pulley arrangement, the main shaft 19 and hub 20 secured thereto. Thus, all of these components are rotated in the same direction and in order to provide a means whereby the lapping tool is caused to rotate in an opposite direction a plurality of pulleys and a single belt is employed to effect the counter-rotation of the lapping tool with respect to the chuck 25 in which is held a die 56 which is to be reconditioned in a manner set forth hereinafter.

Referring now particularly to FIG. 7 of the drawings there is shown therein a pulley 55 which is keyed for rotation with the main shaft 19. The belt 57 trained over pulley 55 fixed to the shaft 19 then extends in the direction of the arrow to a pulley 59 mounted for rotation on a fixed shaft 60 secured in any manner to the base 10 of the apparatus. Thence, the belt 57 leads to the pulley 58 as indicated by the arrows and then on to a second pulley 61 rotatable on fixed shaft 60 as indicated by the arrow and back to the aforesaid pulley 55. Thus, with the arrangement of the single belt and plural pulleys, the shaft 52, chuck 53 mounted thereon, and lapping tool 54 also mounted thereon, will be caused to rotate in a direction opposite to the rotation of the main shaft 19 and parts associated therewith.

As stated previously, the hub 20 is secured to and mounted concentrically with the shaft 19. In order to effect a vertical reciprocating motion to the block 37 which translates this motion into a horizontal reciprocating motion, the plate 27 is moved in the slot 26 so as to position the same off center with respect to the horizontal axis of the shaft 19. Once the plate has been moved in the aforesaid slot to the desired position, the same is retained in the slot by tightening the set screw 29 which extends through a suitable opening formed in the plate and engage with the base of the slot to retain the plate in its adjusted position in the slot. As can be appreciated the further off center the plate is placed with respect to the horizontal axis of the shaft 19, the greater will be the line of travel of the connector rods 31 and 33, thus resulting in a greater up and down movement of the block 37 with consequent longer length of horizontal travel of the housing 49 and shaft mounted therein as well as the lapping tool mounted on the shaft in the manner set forth previously. Graduation may be provided on the plate 27 so as to enable the operator of the apparatus to determine the length of travel of the aforesaid lapping tool.

As can be appreciated, the position of the plate in the slot will lengthen or shorten the distance between the connector rods 31 and 33. However, as the rods are threaded on to an externally threaded bolt 32, the rods may be adjusted to the proper length and when this has been accomplished, lock nuts 63 may be employed for retaining the rods in their desired adjusted position. As can best be seen in FIG. 9 of the drawings, the bearing extending between the bifurcated arms 35, 36 will permit for the rods to assume various positions with respect to the plate and bearing while still continuing to be connected to the bearing 34 and set screw 29 and bearing 30 provided on the lower connector rod 31.

Figure 5:
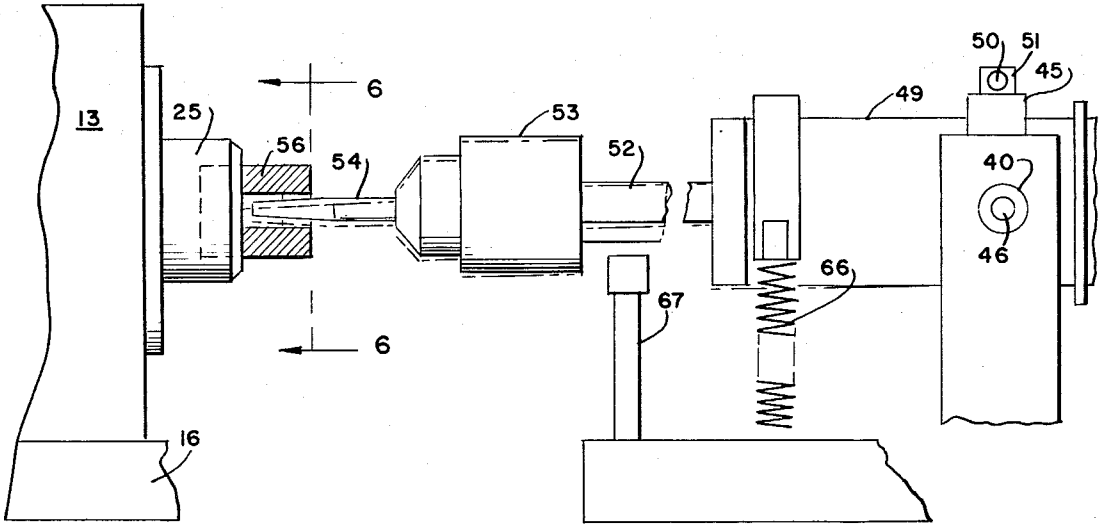
FIG. 5 is an enlarged view, with parts broken away showing the manner in which the lapping tool engages with the die opening which is to be finished and, FIG. 6 is an enlarged view taken on line 6—6 of FIG. 5, looking in the direction of the arrows showing the contact of the lapping tool with a die to be finished.
Figure 6:
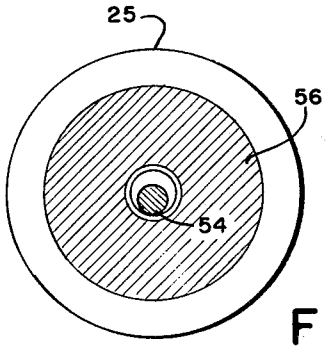
Figure 10:
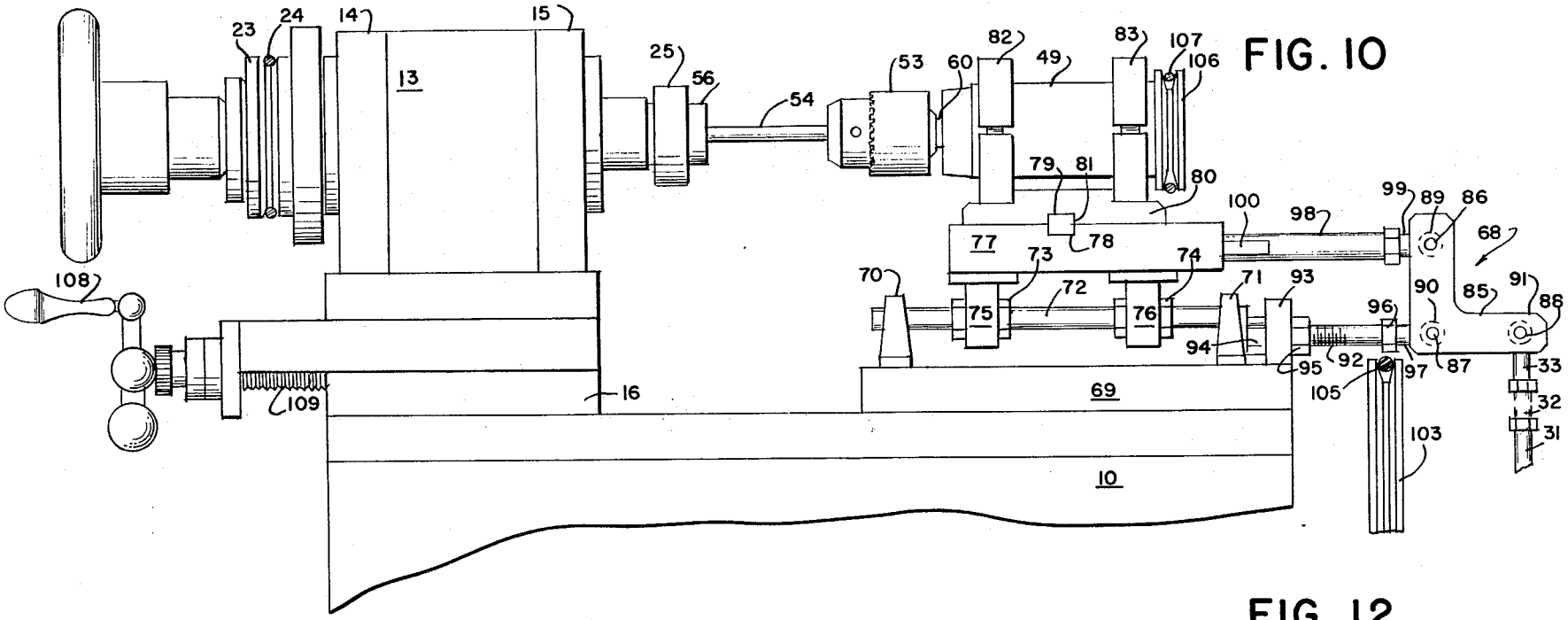
FIG. 10 is a still further modification of the die lapping apparatus embodying my inventions.

To secure the shaft 52 to the housing 49 so as to cause the same to reciprocate in the manner aforesaid, a hand wheel 64 is provided. Tightening of the hand wheel on an externally threaded portion 65 extending from the housing 49 will effect a tightening of this member on the shaft to secure the same in proper position on the apparatus so that the tool carrying end of the shaft 52 will be properly positioned with respect to the die to be conditioned so that when the apparatus is operated to lap a die the tapered portion on the lapping tool will extend into the die to effect a lapping thereof when the shaft is rotated and simultaneously reciprocated in the manner set forth above. The tapered tool shown particularly in FIGS. 1, 5 and 6, comprises a pin-like member secured in chuck 53 and during the polishing operation of the die the tapered or forward position of the tool is adapted to engage in point contact only the inner surfaces of the conical area of the die to thus remove from thereon any imperfections and to ultimately polish this area of the die. In instances where it is desired to increase lapping pressure a spring 66 is secured in any manner to the base 10 and to the housing 49 and may be employed to exert a downward pull on the housing which will in turn cause said shaft 52 and reconditioning tool 54 to be biased downwardly so as to cause the tapered portion of the reconditioning tool to engage in point contact only the wall of the conical area of the die. Following the polishing of the conical area of the die, and should the land portion of the die also require a reconditioning operation, the tool 54 is exchanged for a tool having an external diameter less than the internal diameter of the land portion of the die, and again the land polishing tool is caused to engage the land area in point contact only to polish this area of the die.

Following the reconditioning of the die in the manner aforesaid, the lapping tool may be removed from the chuck and the shaft or spindle 52 and chuck carried thereby allowed to rest on a vertically extending post 67 mounted in any known manner on the base 10. Shown in full lines in FIG. 5 of the drawings is the position of the lapping tool prior to application of a downward pull thereon by the aforesaid spring 66 whereas the dotted line position shows the tapered end of the lap tool in engagement in point contact only with the conical wall of the die.

Shown in FIGS. 3, 3A, 10, 11 and 12 is a modification of the invention and there is shown therein a die recondition apparatus which will produce a rough grinding of a die. As stated previously, in certain instances a rough ground die can be employed in lieu of a polished die in the drawing of a stock therethrough. Again, the lapping or grinding tool is designed to simultaneously rotate and reciprocate during the reconditioning of the die. The means for effecting the aforesaid rotating and reciprocating movement of the tool is essentially the same as previously described with respect to the other views of the drawings, except that in this modification of the invention a bell crank 68 which is essentially L-shaped extends between the connector rod 33 and the reciprocating housing 49 from which extends the shaft or spindle 60 which has mounted thereon the chuck 53 in which is secured the lap or grinding tool 54.

Secured in any manner on the upper surface of the base 10 is a supporting block 69 having a pair of vertical brackets 70, 71. A stationary rod 72, preferably circular in cross-section is mounted on said brackets and a pair of bearings 73, 74 are mounted on the rod 72 and held thereon by means of a pair of straps 75, 76 encircling the same and are secured in any known manner to the undersurface of a slidable block 77 provided with key-way 78 extending transversely of the said block and a like key-way 79 is formed on the housing supporting block 80. A suitable key 81 extends in the said key-ways 78, 79 retaining the housing in proper position on the said block 77.

A pair of brackets 82, 83 extend around the housing 49 and are secured in any known manner to the support block 80, for securing the same to the said block and to move in unison therewith when reciprocating movement is imparted to the said slidable block 77 in a manner to be described more fully hereinafter.

Figure 2:
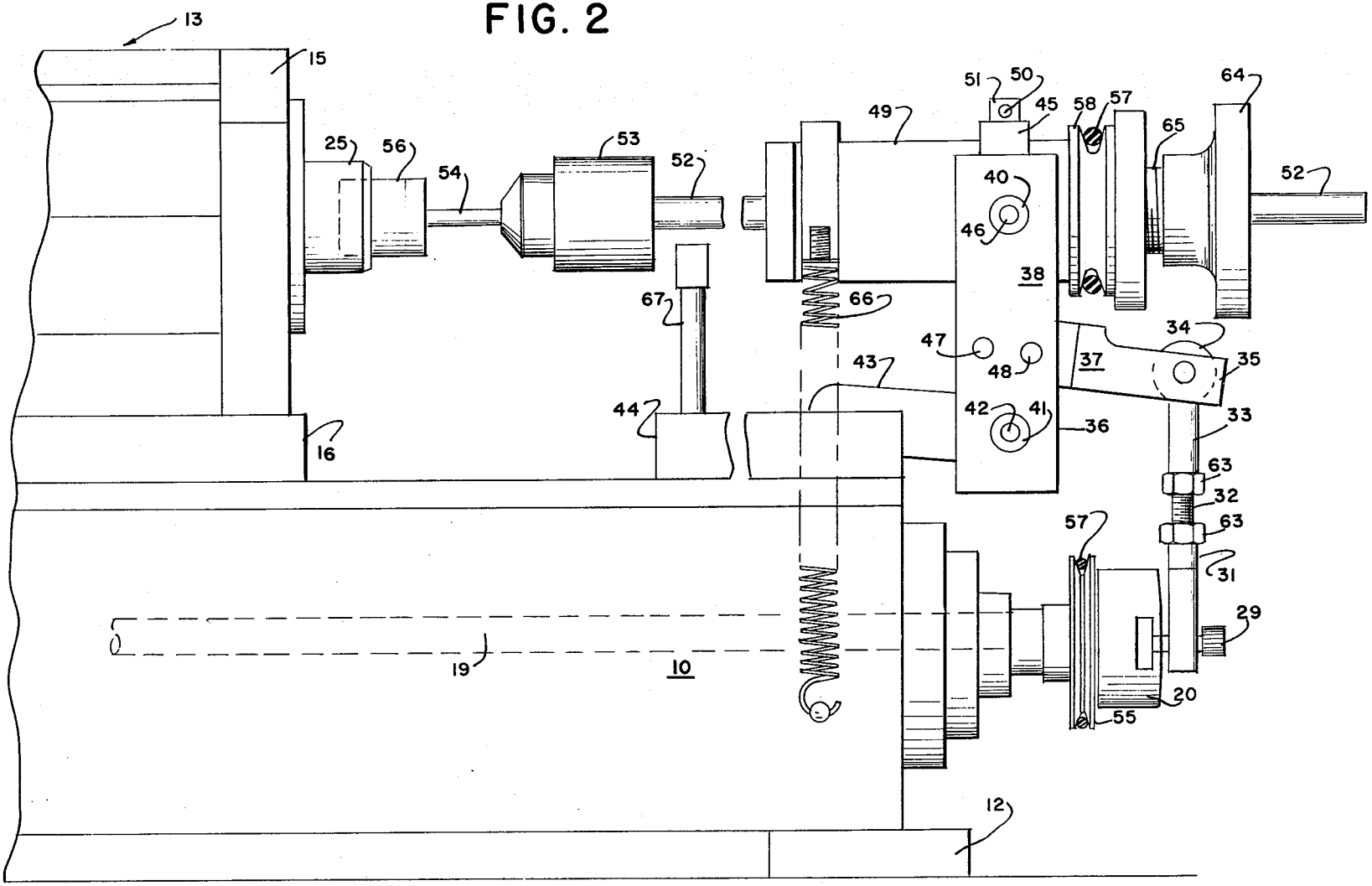
FIG. 2 is an enlarged view showing the spindle driving end of the die lapping apparatus.
Figures 3, 3A:
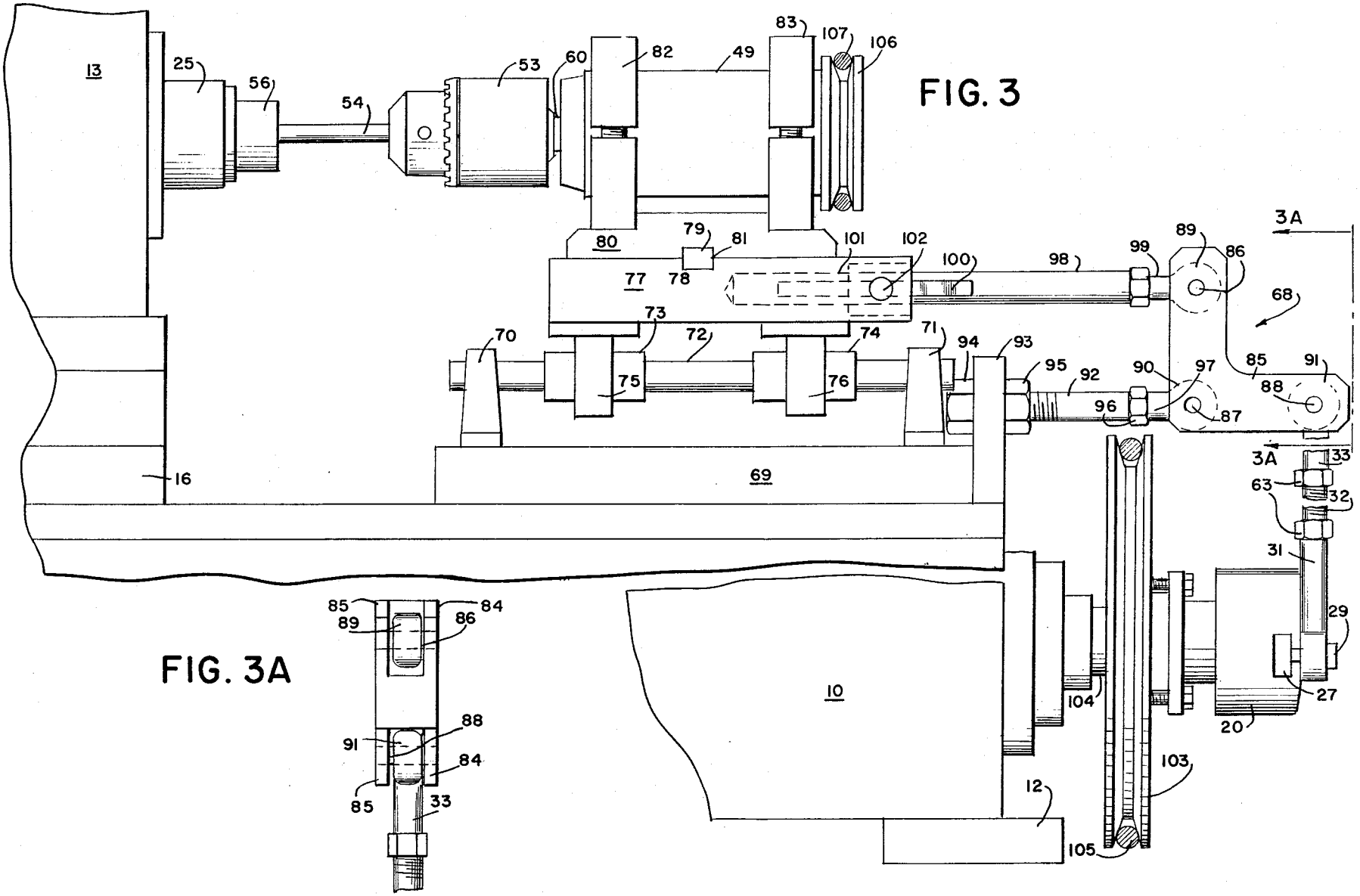
FIG. 3 is a modification of the die lapping apparatus embodying my invention.
FIG. 3A is a section taken on line 3–A of FIG. 3 looking in the direction of the arrows.

The bell crank 68 comprises a pair of spaced apart L-shaped members 84, 85 and mounted on suitable shafts 86, 87, 88 are bearings 89, 90, 91. An externally threaded shaft 92 extends from the center pivot point of the bell crank 68 and extends through an opening formed in a vertically extending bracket 93 which is secured in any known manner to stationary support block 69. A pair of lock nuts 94, 95 extend on either side of the said bracket 93 whereupon the length of the shaft 92 with respect to the said bracket 93 may be adjusted and held is adjusted position by means of the said lock nuts. A like lock nut 96 is also mounted on the shaft 92 to lock the shaft in adjusted position with respect to the connector rod 97 to which is affixed the bearing 90. It will be understood that the connector rods 31, 33 extending from one end of the bell crank 68 will connect to the plate mounted in the slot formed in the hub in the same manner as previously described with respect to the other figures of the drawings, particularly FIG. 2 thereof and the length of reciprocating travel of the lapping or ripping tool will be dependent on the position of the plate in the slot, also in the manner previously described.

The upper pivot point of the bell crank 68 is connected to the slidable block 77 by means of a shaft 98 which is secured to connector rod 99 on which is mounted the bearing 89. The shaft 98 is provided with a flattened surface 100 and the forward end of the shaft extends into an opening 101 formed in the block 77 and a set screw 102 extends into the block 77 and engages with the flattened surface to retain the shaft 98 in it's proper position within the said opening.

A pulley 103 is keyed or otherwise secured to a shaft 104 extending from the base 10 and a belt 105 extends to a suitable motor (not shown) to thereby impart a rotating motion to the said shaft 104 and the hub 20 which is keyed or otherwise secured to the same shaft. Thus, rotation of the hub 20 will be effected by said power means.

As explained previously, and with the plate 27 mounted off-center the axis of rotation of the said hub, rotation of the hub will cause the connector rods 31, 33 to travel in an up and down movement causing the bell crank arms to move in an arcuate path thus effecting a reciprocating movement of the block 77 and parts mounted thereon, including the lap or grinding tool 54. To effect a rotation of the tool 54, a pulley 106 is keyed to shaft 60 which extends from the housing 49 and a belt 107 extends to a suitable source of power such as an electric motor (not shown). Mounted on the head stock 13 is a pulley 23 having a belt 24 trained thereover which leads to a suitable source of power such as an electric motor (not shown) for effecting a rotation of the chuck 25 and die 56 mounted therein. However, the chuck and die mounted therein will be rotated in a direction opposite the rotation of the chuck 53 and tool mounted therein.

As stated previously, the headstock 13 is mounted on a support plate 16 which is mounted for movement in the key-way 17 formed along the upper surface of the base 10. Movement of the plate 16 and headstock secured thereto within the said key-way can be effected by a hand wheel 108 secured in any manner to an externally threaded shaft 109 which extends into the support plate 16.

Figure 12:
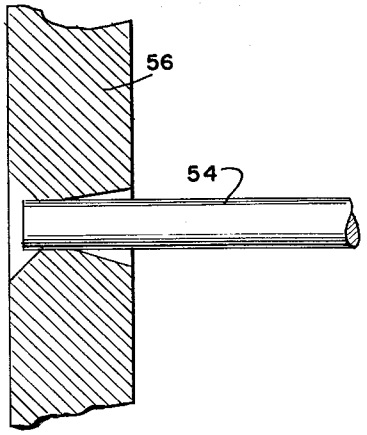
Figure 11:
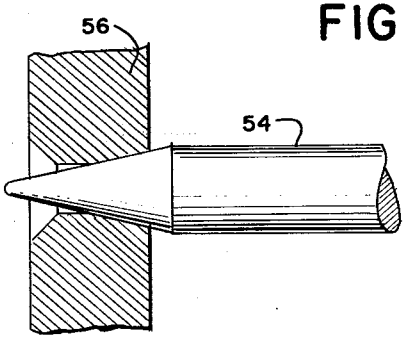
FIG. 11 is an enlarged view with parts broken away showing the manner in which a lapping tool can engage with the conical walls of a die to be rough ground, and, FIG. 12 is an enlarged view with parts broken away showing the manner in which the land area of a die is to be rough finished.

In the rough grinding of a die, the tool employed for grinding the conical portion of the die engages this surface throughout 360° as shown in FIG. 11 of the drawings, and the tool for grinding the land portion of the die also engages this portion of the die, again throughout 360° as shown in FIG. 12 of the drawings.

The operation of the die conditioning apparatus shown in FIGS. 3, 3A, 10, 11 and 12 is as follows:

Since the die conditioning tool contacts not only the conical portion of the die but the land portion as well for a full 360° during the rough grinding operation, it is imperative that the conditioning tool be centered with respect to these areas of the die. To center the die with respect to the conditioning tool, the operator of the apparatus places the die in the collet of the chuck and by using a proper instrument he can determine the line of travel of the die and when the die rotates on a true center the tool is locked in chuck 25 and the grinding operation may then proceed. Reciprocation of the lap or grinding tool 54 will be effected by the reciprocating block 77 and housing 49 mounted thereon by reason of the arcuate travel of the bell crank secured to the block and to the rotating hub 20 in the manner previously described. The tool 54 is caused to rotate in one direction whereas the die is rotated in the opposite direction. With the die rotating in one direction and the tool rotating in an opposite direction and simultaneously being reciprocated, the operator then proceeds to feed the die towards the conditioning tool by operating the hand wheel to slide the complete headstock towards the conditioning tool. Following the rough grinding of the conical portion of the die the head-stock is moved away from the tool and should it be necessary to grind the land portion of the die, a circular tool which is designed to engage with this portion of the die is substituted and the procedure repeated to recondition this portion of the die. Thus it will be seen that with the one apparatus a rough grinding of all portions of a die can be effected thus eliminating the employment of a separate apparatus for accomplishing the same grinding operations.

The combined rotating and reciprocating motion of the lapping tool will effect a smoothing or polishing of the die insert in the event a highly polished die is desired whereas if it is not necessary that the insert be highly polished, a rough grinding of the insert can be accomplished again by simultaneously reciprocating and rotating the tool employed for reconditioning the die.

Thus, it will be seen that I have provided a simplified apparatus for effecting the simultaneous rotation and reciprocation of a die lapping tool and while I have referred to the die as one being formed with a carbide insert, it is obvious the apparatus can be adapted to recondition other type dies.

While I have shown and described the preferred embodiments of my invention, I wish it to be understood that I do not confine myself to the precise details of construction herein set forth by way of illustration, as it is apparent that many changes and variations may be made therein, by those skilled in the art, without departing from the spirit of the invention or exceeding the scope of the appended claims.

I claim:

1. A die lapping apparatus which includes a base having a drive shaft extending therefrom with power means for driving the said shaft in one direction and having a headstock mounted on the base and having a rotating die holding chuck extending therefrom rotating in the same direction as the aforesaid drive shaft and wherein a die lapping tool is mounted on a shaft which is simultaneously rotated and reciprocated, the rotation of the shaft having the lapping tool mounted thereon rotating in a different direction opposite the direction of rotation of said drive shaft and die holding chuck, the improvement comprising, a hub mounted for rotation on said drive shaft, a slot extending through said hub, a plate mounted off center the axis of rotation of said drive shaft, said plate adjustably mounted in said slot, a linkage secured to said plate and to a lapping tool carrying shaft to effect a reciprocating motion to said tool carrying shaft, said linkage including a pair of plates pivotally mounted on said base and on a housing in which the lapping tool carrying shaft is mounted for rotation therein and to be simultaneously reciprocated when said hub and plate mounted therein is rotated, and means to effect a rotary motion to said tool carrying shaft while the same is simultaneously reciprocated.

2. A die lapping apparatus which includes a base having a drive shaft extending therefrom with power means for driving the said shaft in one direction and having a headstock mounted on the base and having a rotating die holding chuck extending therefrom rotating in the same direction as the aforesaid drive shaft and wherein a die lapping tool is mounted on a shaft which is simultaneously rotated and reciprocated, the rotation of the shaft having the lapping tool mounted thereon rotating in a different direction opposite the direction of rotation of said drive shaft and die holding chuck, the improvement comprising, a hub mounted for rotation on said drive shaft, a slot extending through said hub, a plate mounted off center the axis of rotation of said drive shaft, said plate adjustably mounted in said slot, a linkage secured to said plate and to a lapping tool carrying shaft to effect a reciprocating motion to said tool carrying shaft, said linkage includes a pair of connector rods engaged to each other end to end, the upper end of said pair of connector rods swivelly mounted by an appropriate bearing fixed between a pair of arms connected to said tool carrying shaft, the lower end of said pair of connector rods attached to said plate by an appropriate bearing assembly fixed to the lower end of the lower connector rod, and means to effect a rotary motion to said tool carrying shaft while the same is simultaneously reciprocated.

* * * * *